US011007800B2

(12) United States Patent
Mizutani

(10) Patent No.: US 11,007,800 B2
(45) **Date of Patent: *May 18, 2021**

(54) CUTTING DEVICE

(71) Applicant: BROTHER KOGYO KABUSHIKI KAISHA, Nagoya (JP)

(72) Inventor: Hiromitsu Mizutani, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 218 days.

This patent is subject to a terminal disclaimer.

(21) Appl. No.: 16/220,330

(22) Filed: Dec. 14, 2018

(65) Prior Publication Data

US 2019/0299668 A1 Oct. 3, 2019

(30) Foreign Application Priority Data

Mar. 30, 2018 (JP) ..... JP2018-066306

(51) Int. Cl.
*B41J 11/66* (2006.01)
*B26D 1/30* (2006.01)
(Continued)

(52) U.S. Cl.
CPC ..... *B41J 11/666* (2013.01); *B26D 1/305* (2013.01); *B41J 3/4075* (2013.01); *B41J 11/703* (2013.01)

(58) Field of Classification Search
CPC ... B41J 3/44; B41J 3/4075; B41J 11/66; B41J 11/68; B41J 11/993; B41J 11/666;
(Continued)

(56) References Cited

U.S. PATENT DOCUMENTS 5,957,597 A 9/1999 Kato
6,694,854 B2 * 2/2004 Furuya ..... B26D 3/085 83/563

(Continued)

FOREIGN PATENT DOCUMENTS

JP S52-112414 A1 9/1977
JP H11-170638 A 6/1999

(Continued)

OTHER PUBLICATIONS

Notice of Reasons for Refusal dated Feb. 24, 2021 received from Japanese Patent Office in related JP application No. 2018-066306 together with English language translation.

(Continued)

*Primary Examiner* — Matthew G Marini
*Assistant Examiner* — Marissa Ferguson-Samreth
(74) *Attorney, Agent, or Firm* — Scully, Scott, Murphy & Presser, PC

(57) ABSTRACT

A cutting device, including a rotating body, a first link member, a second link member, a placement part, and a movable blade holder, is provided. The first link member swings according to rotation of the rotating body, and the second link member swings according to swing movement of the first link member. The movable blade holder swings according to swing movement of the second link member and includes a basal end portion, a distal end portion, and an attachment portion, on which a movable blade to cut a printing medium is attached. The movable blade holder is configured to swing between a cutting position, at which the printing medium is nipped between the movable blade and the placement part to be cut by the movable blade, and a retracted position retracted from the cutting position.

13 Claims, 10 Drawing Sheets

(51) Int. Cl.
*B41J 3/407* (2006.01)
*B41J 11/70* (2006.01)

(58) Field of Classification Search
CPC ..... B41J 11/703; B41J 29/393; B26D 1/025; B26D 1/085; B26D 11/00; B26D 1/105; B26D 1/141; B26D 2001/0066
See application file for complete search history.

(56) References Cited

U.S. PATENT DOCUMENTS 10,549,559 B2 * 2/2020 Mizutani ..... B41J 11/703
2015/0084262 A1 * 3/2015 Sago ..... B41J 11/70 270/1.01
2015/0183238 A1 * 7/2015 Kano ..... B41J 11/703 347/218
2016/0288541 A1 * 10/2016 Kano ..... B26D 1/06
2019/0299668 A1 10/2019 Mizutani

FOREIGN PATENT DOCUMENTS

JP 2009-051165 A 3/2009
JP 2019-171551 A 10/2019

OTHER PUBLICATIONS

Notice of Reasons for Refusal dated Mar. 2, 2021 received from Japanese Patent Office in related JP application No. 2018-066307 together with English language translation.
Notice of Reasons for Refusal dated Feb. 9, 2021 received from Japanese Patent Office in related JP application No. 2018-066309 together with English language translation.

* cited by examiner

CUTTING DEVICE

CROSS REFERENCE TO RELATED APPLICATION

This application claims priority from Japanese Patent Application No. 2018-066306, filed on Mar. 30, 2018, the entire subject matter of which is incorporated herein by reference.

BACKGROUND

Technical Field

An aspect of the present disclosure is related to a cutting device capable of cutting a printing medium.

Related Art

A cutting device capable of cutting a printing medium is known. The cutting device may cut the printing medium partially in a so-called half-cutting fashion or partial-cutting fashion, in which a part of the printing medium is cut while another part of the printing medium is left uncut, or fully in a so-called full-cutting fashion, in which the printing medium is fully separated into pieces.

A half-cutting device may include a placement table, a supporting member, a cutting blade, and a driving device. The placement table may be a metal-made board, on which a printable tape may be placed. At a base of the placement table, a caulking pin may be attached. The supporting member may extend approximately vertically and may be swingably supported by the caulking pin at an approximately vertically central position thereof. The cutting blade may be fixed to the supporting member at an upper position with respect to the caulking pin. The driving device may include a motor, a gear train connected with the motor, and a crank connected with the gear train and the supporting member. The crank may be formed to have a guide groove, with which a pin attached to a lower area in the supporting member may engage. As a driving force from the motor is transmitted to the crank through the gear train, the crank may rotate, and the supporting member may swing about the caulking pin. Thereby, the cutting blade may nip and cut the printable tape partially at a position between the cutting blade and the placement table.

SUMMARY

In the half-cutting device, the cutting blade may be fixed to the supporting member at an upper position with respect to the caulking pin, and the supporting member may be connected with the crank at a lower position with respect to the caulking pin. In this regard, the supporting member may require a substantial length in a vertical direction; therefore, a volume of the half-cutting device may tend to increase.

The present disclosure is advantageous in that a size-reducible cutting device is provided.

According to an aspect of the present disclosure, a cutting device configured to cut a printing medium, including a rotating body, a first link member, a second link member, a placement part, and a movable blade holder, is provided. The rotating body is configured to be driven to rotate by a driving force from a driving source. The first link member is swingably supported by a frame and is configured to swing according to rotation of the rotating body. The second link member is swingably supported by the frame and is configured to swing according to swing movement of the first link member. The placement part is fixed to the frame and has a first end on one side of the cutting device in a predetermined direction and a second end on the other side of the cutting device opposite to the first end in the predetermined direction. The placement part is configured to place the printing medium thereon at a position between the first end and the second end. The movable blade holder is configured to swing according to swing movement of the second link member. The movable blade holder includes a basal end portion, a distal end portion, and an attachment portion. The basal end portion is located on one end on the one side of the cutting device in the predetermined direction and is swingably supported by the placement part at the first end. The distal end portion is located on the other end opposite to the basal end portion on the other side of the cutting device in the predetermined direction and is connected with the second link member. The attachment portion is located between the basal end portion and the distal end portion. The attachment portion is configured to attach a movable blade thereon and is configured to cut the printing medium. The movable blade holder is configured to swing between a cutting position, at which the printing medium is nipped between the movable blade and the placement part to be cut by the movable blade, and a retracted position retracted from the cutting position.

BRIEF DESCRIPTION OF THE ACCOMPANYING DRAWINGS

DETAILED DESCRIPTION

Hereinafter, with reference to the accompanying drawings, described below will be a printing apparatus 100 according to the embodiment of the present disclosure. It may be noted that structures of the printing apparatus 100 according to the present disclosure may not necessarily be limited to those shown in the accompanying drawings or described in the paragraphs below but may be regarded as merely an example.

In the embodiment described below, directions related the printing apparatus 100 and parts and members included in the printing apparatus 100 will be mentioned on basis of a posture of the printing apparatus 100 with reference to arrows in each drawing. A front-to-rear or rear-to-front direction may be expressed as a front-rear direction, an up-to-down or down-to-up direction may be expressed as a vertical direction, and a left-to-right or right-to-left direction may be expressed as a crosswise direction.

Figure 1:
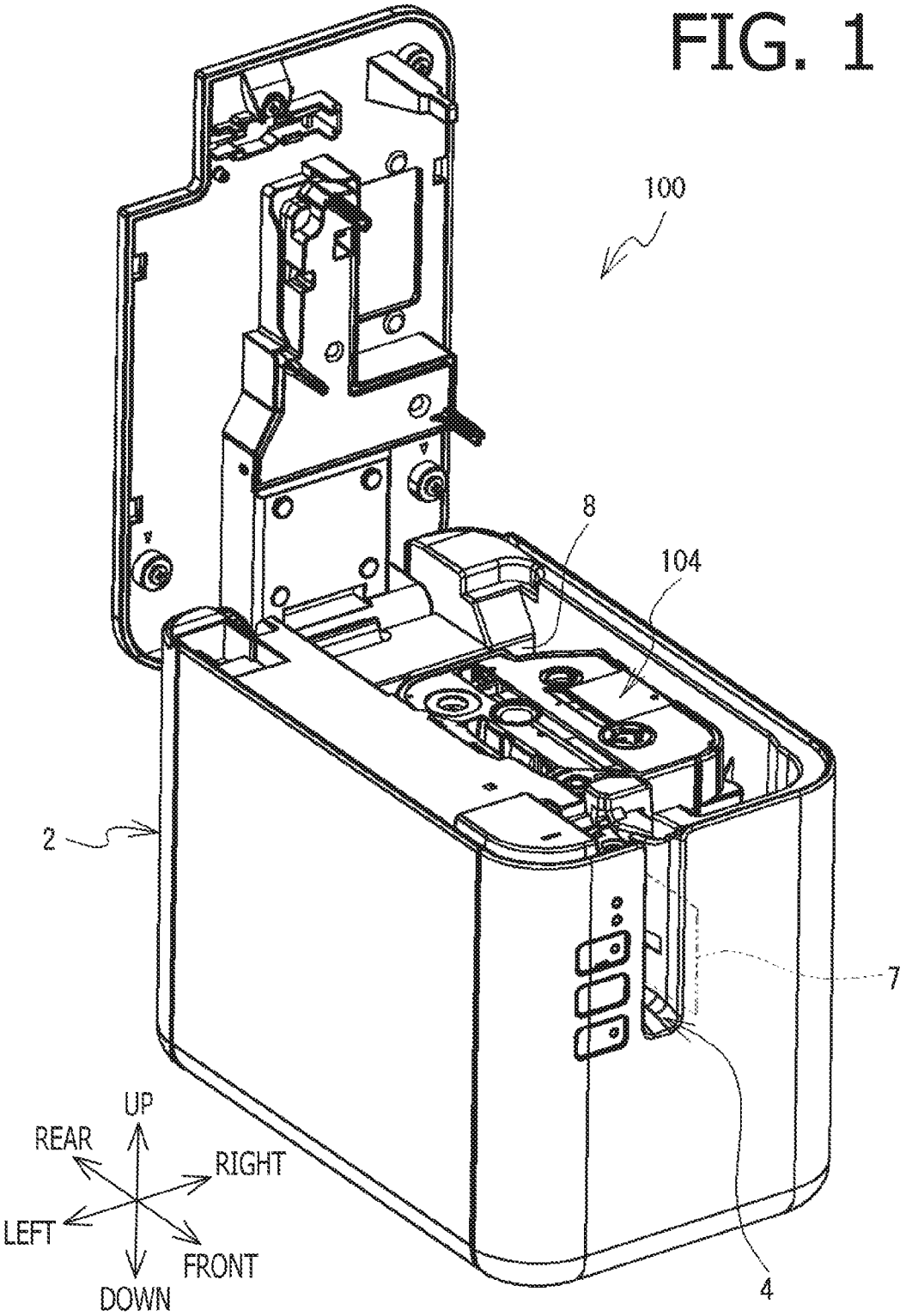
FIG. 1 is a perspective view of a printing apparatus 100 according to an embodiment of the present disclosure.
Figure 2:
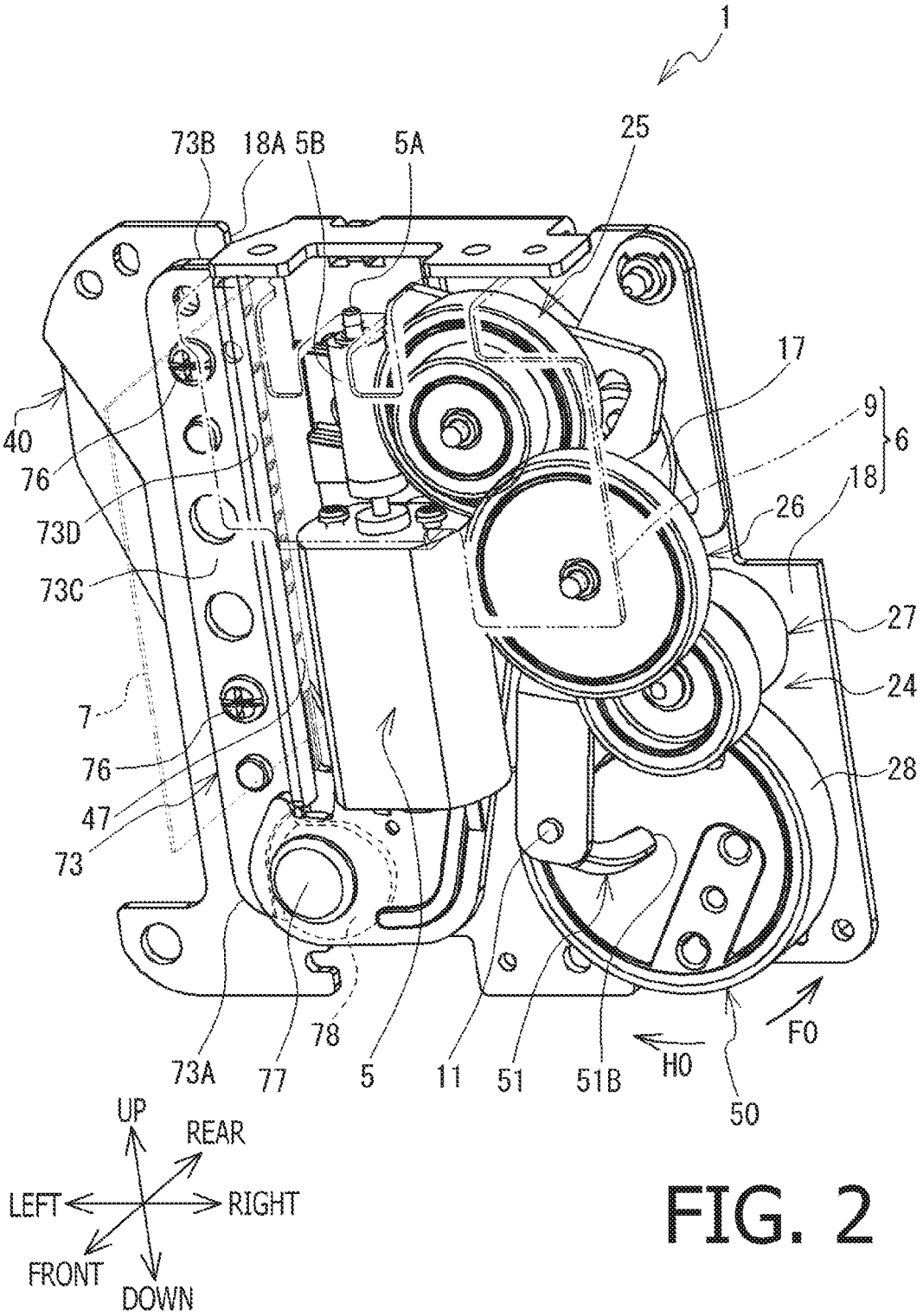
FIG. 2 is a perspective view of a cutting device 1 in a ready condition according to the embodiment of the present disclosure.

With reference to FIGS. 1 and 2, described below will be an overall configuration of the printing apparatus 1. The printing apparatus 100 may print an image on a printing medium 7 and cut the printed part of the printing medium 7 halfway of the thickness or fully through the thickness. The printing medium 7 may be a strip of sheet, as shown in FIGS. 1 and 2. A width of the printing medium 7 may be, for example, 51 mm. The printing apparatus 100 includes a main case 2. The main case 2 has an approximate shape of a box, in which an attachment room 8 is formed. The attachment room 8 is a deepened downward from upper edges of the main case 2 and is open upward, and a cassette 104 containing a roll of printing medium 7 may be attached thereto. On a front face of the main case 2, arranged is an outlet 4, through which the printing medium 7 may be ejected. The printing apparatus includes a plurality of rollers and a thermal head, which are not shown. The rollers may draw the printing medium 7 stored in the cassette 104 outward and convey the printing medium 7 toward the outlet 4. A conveying direction, in which the printing medium 7 may travel through the outlet 4, is in parallel with the front-rear direction. The thermal head may print an image on the printing medium 7. The rollers and the thermal head may be in known configurations as disclosed in, for example, Japanese Patent Provisional Publication No. H11-170638.

The printing apparatus 100 is equipped with a cutting device 1, which may cut the printing medium 7 with an image printed thereon. The printing medium 7 may be, for example, a known printable tape having a printable base and an adhesive tape, of which illustration are herein omitted. The printable base may be a strip of transparent film tape and may have a printable surface on one side thereof. The adhesive tape may include a background base, a first adhesive layer applied to an outward surface of the background base, a second adhesive layer applied to an inward surface of the background base, and a release paper. The release paper may adhere to the background base through the second adhesive layer. The adhesive tape may adhere to the printable surface of the printable base with the image printed thereon through the first adhesive layer. Thus, the printing medium 7 may include five (5) layers, which are the printable base, the first adhesive layer, the background base, the second adhesive layer, and the release paper. Meanwhile, the cutting device 1 according to the present disclosure may cut the printing medium 7 partially and fully. As will be described further below, the cutting device 1 may cut the printing medium 7 halfway in a half-cutting action or fully in a full-cutting action. In particular, in the half-cutting action, the cutting device 1 may nip the printing medium 7 between a placement board 73D and a movable blade 3 and cut the printable base, the background base, and the first and second adhesive layers. In other words, the half-cutting action may cut the printable medium 7 except the release paper. On the other hand, in the full-cutting action, the cutting device 1 may nip the printable medium 7 between a stationary blade 79 and a full-cutting blade 40 and cut the printing medium 7 fully through the printable base, the background base, the first and second adhesive layers, and the release paper.

With reference to FIGS. 2-6, described below will be a detailed configuration of the cutting device 1. In FIGS. 3-4 and 7-8, illustration of a front plate 9, a motor 5, a motor gear 5B, a first gear 25, and a second gear 26 in the cutting device 1, which will be described further below, is omitted. The cutting device 1 is stowed in the main case 2 at a rearward position with respect to the outlet 4.

As shown in FIG. 2, the cutting device 1 has a frame 6, which is fixed to an internal structure (not shown) in the main case 2 (see also FIG. 1). The frame 6 includes a flat plate 18, having an approximate shape of a rectangle in a plan view, and a front plate 9, arranged at a frontward position with respect to the flat plate 18. The front plate 9 is drawn in dash-and-dots lines in FIG. 2. The flat plate 18 has a passage opening 18A, which is formed through the flat plate 18 in the front-rear direction. The passage opening 18A extends in the vertical direction and is formed at a position coincident with the outlet 4 in the front-rear direction to allow the printing medium 7 to travel there-through. On a leftward side of the passage opening 18A, arranged is a guiding member 47. The guiding member 47 has a plurality of ribs, which project rightward, aligning in the vertical direction. The guiding member 47 may guide the printing medium 7 being forwarded at the outlet 4.

To the flat plate 18, fixed is a placement base 73, which is in a form of a plate. The placement base 73 includes a first end 73A, a second end 73B, a linear portion 73C, and a placement board 73D. The first end 73A forms a lower end of the placement base 73 and is located to be lower than the passage opening 18A. The first end 73A includes a protrusion 78, which protrudes frontward. To a central area in the protrusion 78 in a front view, fixed is a shaft member 77, which axially extends in the front-rear direction. The second end 73B forms an upper end of the placement base 73. The linear portion 73C extends between the first end 73A and the second end 73B of the placement base 73. The linear portion 73C is fixed to the flat plate 18 by two (2) screws 76 at a leftward position with respect to the passage opening 18A. The placement board 73D has a rectangular shape extending in the vertical direction in a view from the right and protrudes frontward from a rightward end of the linear portion 73C. On the placement board 73D, placed may be a portion of the printing medium 7 that is located upstream, i.e., rearward, from the guiding member 47 in the conveying direction.

At a rightward position with respect to the passage opening 18A, fixed to a lower end of the front plate 9 is the motor 5. The motor 5 includes an output shaft 5A extending upward. The motor 5 may be, for example, a DC motor. To the output shaft 5A, fixed is a motor gear 5B. The motor gear 5B may be a worm gear. In FIG. 2, illustration of threads in the motor gear 5B is omitted, and the motor gear 5B is illustrated in a form of a rod.

At a lower-rightward and rearward position with respect to the motor 5, arranged is a rotating body 50. The rotating body 50 has a circular shape in a front view and is located at a rightward position with respect to the shaft member 77. The rotating body 50 is rotatably supported by a shaft 59 (see FIG. 6). The shaft 59 is located at a rotational center of the rotating body 50. The shaft 59 axially extends in the front-rear direction penetrating through the flat plate 18 in the front-rear direction and is fixed to the flat plate 18.

At a rightward position with respect to the motor 5 and the motor gear 5B, arranged is a gear train 24. The gear train 24 includes a first gear 25, a second gear 26, a third gear 27, and a fourth gear 28. The first through fourth gears 25-28 align vertically from up to down in this given order and are rotatable about respective axes that extend in the front-rear direction. Illustration of teeth in the first through fourth gears 25-28 is omitted so that the first through fourth gears 25-28 may be expressed in simplified forms of discs. The first gear 25 and the second gear 26 are rotatably supported by the front plate 9. The third gear 27 is rotatably supported by the flat plate 18. The fourth gear 28 is at a downstream end of a driving-force transmitting flow within the gear train 24 and is formed integrally with an outer peripheral surface of the rotating body 50. Each of the first through third gears 25-27 has a larger-diameter gear and a smaller-diameter gear, which are formed integrally to align coaxially in the front-rear direction. The larger-diameter gear in the first gear 25 is a worm wheel, which meshes with the motor gear 5B. The smaller-diameter gear in the first gear 25 meshes with the larger-diameter gear in the second gear 26. The smaller-diameter gear in the second gear 26 meshes with the larger-diameter gear in the third gear 27. The smaller-diameter gear in the third gear 27 meshes with the fourth gear 28. With this arrangement, as the output shaft 5A in the motor 5 rotates, the motor gear 5B rotates, and the first through fourth gears 25-28 rotate to rotate the rotating body 50. In other words, the gear train 24 may transmit the rotating driving force from the motor 5 to the rotating body 50.

Figure 3:
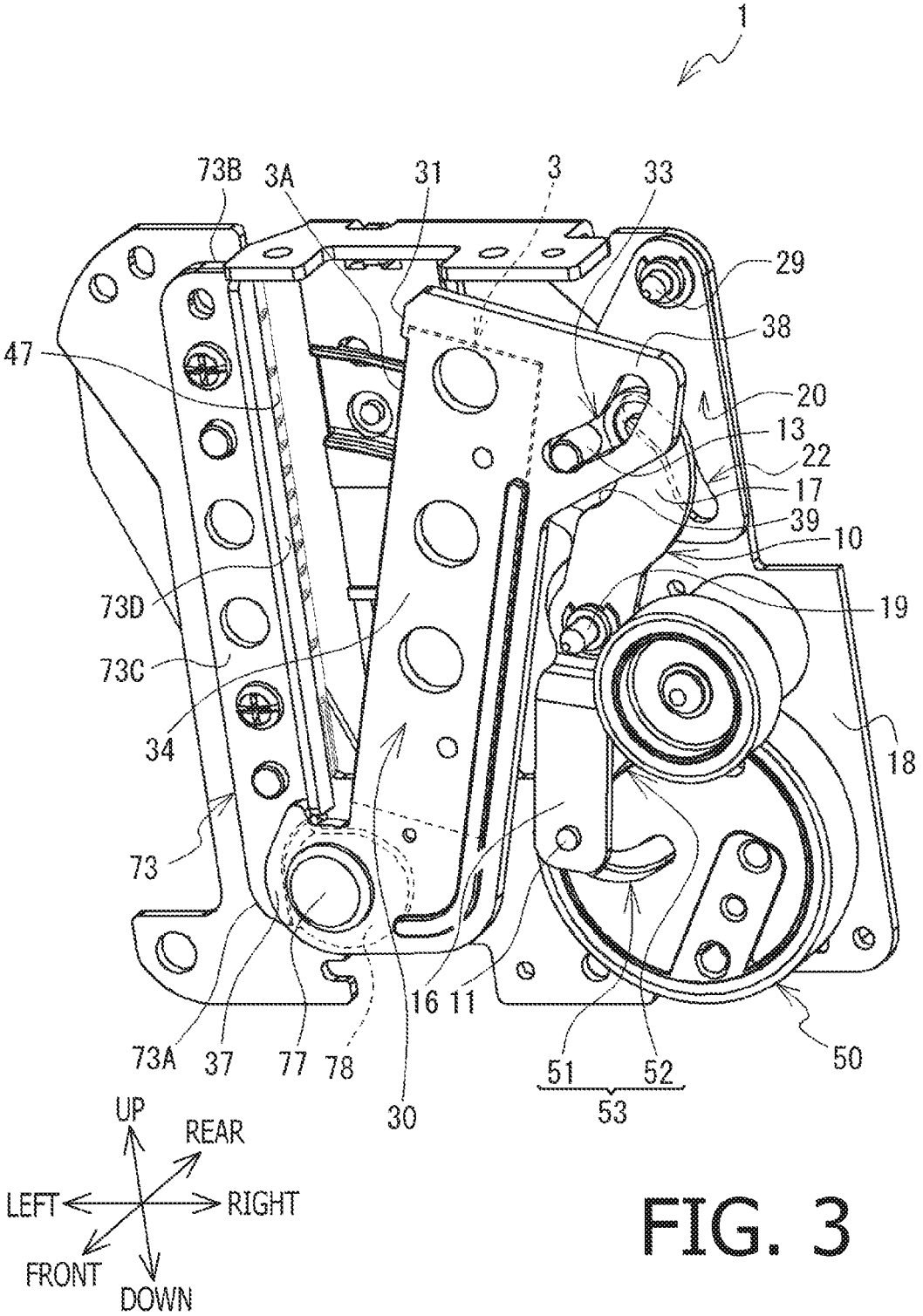
FIG. 3 is another perspective view from the cutting device 1 according to the embodiment of the present disclosure.
Figure 4:
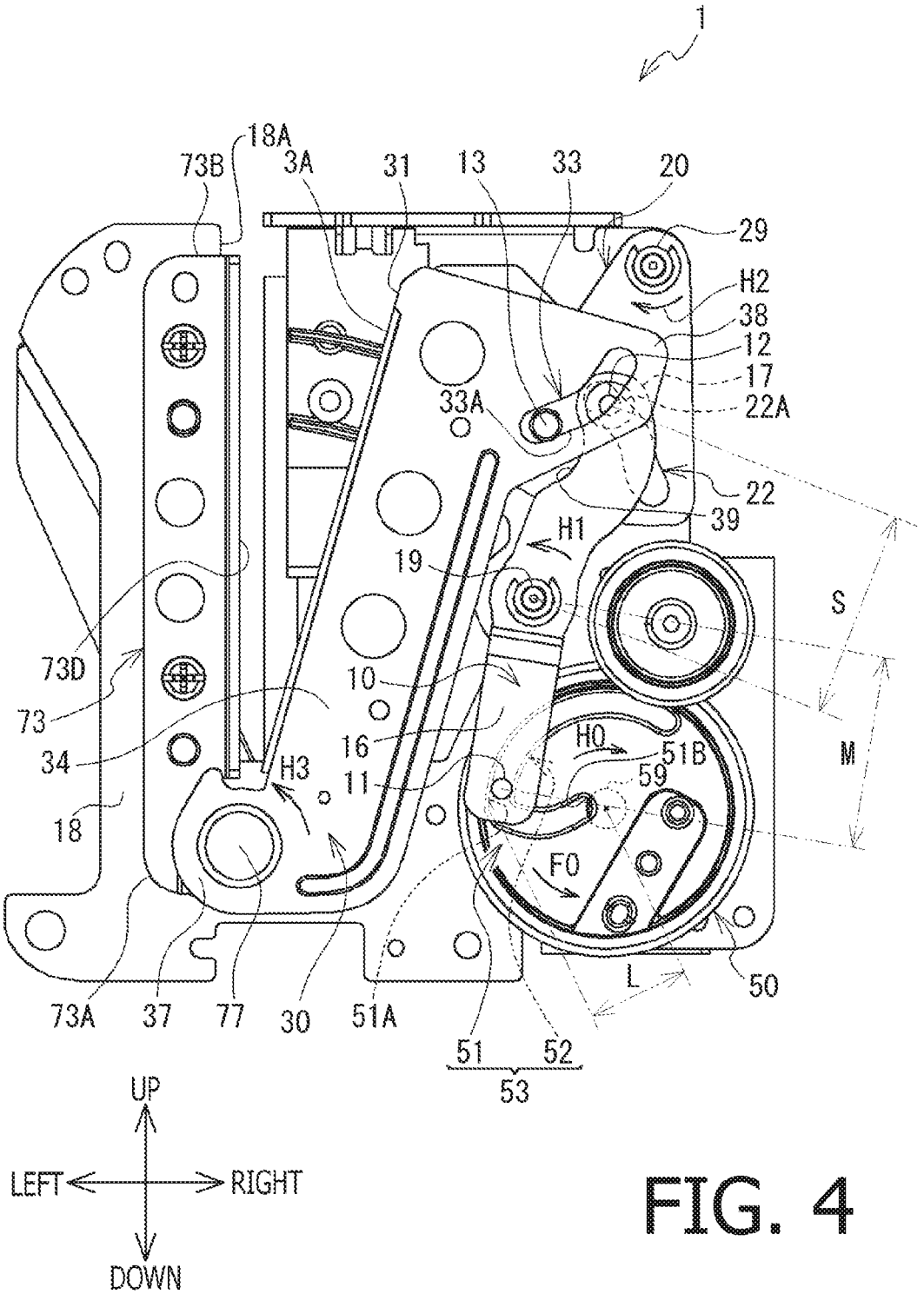
FIG. 4 is a front view of the cutting device 1 in the ready condition according to the embodiment of the present disclosure.

As shown in FIGS. 3 and 4, in the rotating body 50, formed are a first groove cam 51 and a specific groove cam 52. The first groove cam 51 and the specific groove cam 52 are open frontward and are integrated to extend continuously with each other. The first groove cam 51 has a starting edge 51A on one end and a terminal edge 51B on the other end. The first groove cam 51 extends from the starting edge 51A to the terminal edge 51B in a direction to be closer to the shaft 59, which is the rotational center of the rotating body 50. A distance between the starting edge 51A and an axial center of the shaft 59 is defined as a distance of separation for the first groove cam 51 from the shaft 59, which is indicated as a dimension L in FIG. 4. The specific groove cam 52 extends from the starting edge 51A of the first groove cam 51 in an arc centered about the shaft 59 in a clockwise direction in a front view. In other words, the specific groove cam 52 is in a form of an arc centered about the shaft 59. In the following paragraphs, the first groove cam 51 and the specific groove cam 52 may be collectively called as a rotating-body groove cam 53.

At a position upper-leftward with respect to the rotating body 50 in an approximately vertically central area in the flat plate 18, arranged is a first supporting shaft 19. The first supporting shaft 19 protrudes frontward from the flat plate 18 and swingably supports a first link member 10. The first link member 10 extends approximately in the vertical direction and has a through-hole (not shown), which is formed through the first link member 10 in the front-rear direction, at an approximately vertically central position, and the first supporting shaft 19 is inserted in the through-hole. The first link member 10 is arranged to face the flat plate 18 at a position spaced apart from the flat plate 18 in the front-rear direction. A part of the first link member 10 which is lower than the first supporting shaft 19 extends frontward and is bent to extend downward. In other words, the first link member 10 has a cranked shape in a sideward view from the right. The lower part of the first link member 10 forms a first-link first end portion 16, which is located frontward with respect to the rotating body 50. On the first-link first end portion 16, arranged is a first pin 11, which protrudes rearward from the first-link first end portion 16 and engages with the rotating-body groove cam 53. As the rotating body 50 rotates, the first groove cam 51 may move with the first pin 11 sliding therein so that the first link member 10 may swing about the first supporting shaft 19 leftward and rightward. Another part of the first link member 10 which is higher than the first supporting shaft 19 forms a first-link second end portion 17. On the first-link second end portion 17, arranged is a second pin 12. The second pin 12 protrudes rearward from the first-link second end portion 17 and is inserted in a through-hole 97 (see FIG. 6), which is formed through the flat plate 18 in the front-rear direction at an upper-rightward position and has an approximately trapezoidal shape in a rear view. An axis of the second pin 12 extends in the front-rear direction. While the second pin 12 may swing to follow the swing movement of the first link member 10, the pin 12 may not contact inner edges of the through-hole 97. In other words, the through-hole 97 has such a shape and dimensions that the second pin 12 may not contact the inner edges thereof. Moreover, the first-link second end portion 17 is formed to have a recessed portion 39, which is recessed rightward in an arc, on a leftward edge thereof in a front view.

A distance between an axial center of the first pin 11 and an axial center of the first supporting shaft 19 is defined as a distance of separation for the first pin 11 from the first supporting shaft 19, which is indicated as a dimension M in FIG. 4. A distance between an axial center of the second pin 12 and the axial center of the first supporting shaft 19 is defined as a distance of separation for the second pin 12 from the first supporting shaft 19, which is indicated as a dimension S in FIG. 4. The dimension S is larger than the dimension M.

At a position between the first-link second end portion 17 of the first link member 10 and the flat plate 18, arranged is a second link member 20. The second link member 20 is swingably supported by a second supporting shaft 29. The second supporting shaft 29 is located at an upper-rightward position in the flat plate 18, at a rightward position with respect to the second end 73B of the placement base 73. The second supporting shaft 29 protrudes frontward from the flat plate 18. The second link member 20 is a plate having an approximate shape of a fan that spreads from the second supporting shaft 29 and is arranged to face and contact the flat plate 18 from a frontward position. A second-link end portion 21 of the second link member 20 that is farther from the second supporting shaft 29 faces the first-link second end portion 17 of the first link member 10 from a rearward position.

Figure 5:
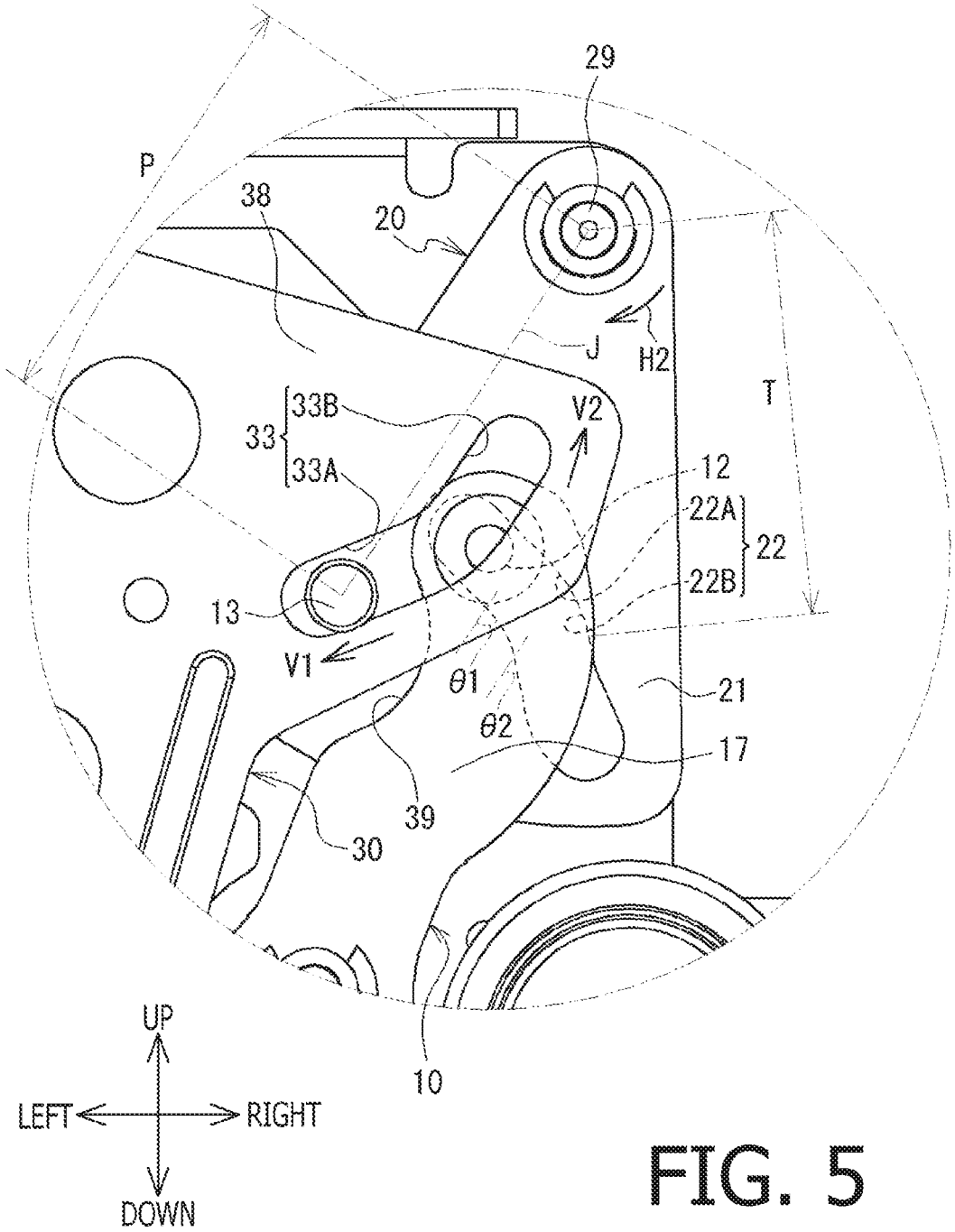
FIG. 5 is a partially enlarged view of a second link member 20 in the cutting device 1 being in the ready condition according to the embodiment of the present disclosure.

As shown in FIG. 5, in the second-link end portion 21, formed is a second groove cam 22. The second groove cam 22 engages with the second pin 12 and includes a first cam section 22A and a second cam section 22B. The first cam section 22A and the second cam section 22B are grooves integrated to extend continuously with each other. Within the second groove cam 22, the first cam section 22A is closer to the second supporting shaft 29, and the second cam section 22B is farther from the second supporting shaft 29. The first cam section 22A extends in a direction to be apart from the second supporting shaft 29, and the second cam section 22B extends from the first cam section 22A in a direction to be further apart from the second supporting shaft 29. As the first link member 10 swings, and the second pin 12 slides with respect to the second groove cam 22, the second link member 20 may swing about the second supporting shaft 29. In the second-link end portion 21, arranged is a third pin 13, which protrudes frontward from the second-link end portion 21. When the first link member 10 and the second link member 20 are in positions shown in FIGS. 3-5, in other words, when a movable blade holder 30 which will be described further below is at a retracted position, the first-link second end portion 17 is at a position closest to the third pin 13. In this position, however, the recessed portion 39 and the third pin 13 are apart from each other without contacting. In other words, the recessed portion 39 is rounded to recess rightward in order to reserve clearance between the third pin 13 and the first-link second end portion 17.

In the following paragraphs, a virtual line that extends between an axial center of the third pin 13 and the axial center of the second supporting shaft 29 will be called as a virtual line J. The axis of the third pin 13 and the axis of the second supporting shaft 29 extends in the front-rear direction therefore in parallel with each other. The first cam section 22A and the second cam section 22B extend in different directions, which respectively intersect with the virtual line J. An inclination θ2 of an acute angle between the extending direction of the second cam section 22B and the virtual line J is smaller than an inclination θ1 of an acute angle between the extending direction of the first cam section 22A and the virtual line J.

A distance between a lower end of a part of the second cam 22 that is slidable to the second pin 12 and an axial center of the second supporting shaft 29 is defined as a distance of separation for the second groove cam 22 from the second supporting shaft 29, which is indicated by a dimension T in FIG. 5. A distance between the axial center of the third pin 13 and the axial center of the second supporting shaft 29 is defined as a distance of separation for the third pin 13 from the second supporting shaft 29, which is indicated as a dimension P in FIG. 5. The dimension P is larger than the dimension T and larger than the dimension L (see FIG. 4).

As shown in FIGS. 3 and 4, at a frontward position with respect to the first-link second end portion 17, arranged is the movable blade holder 30 having a flat plate shape. The movable blade holder 30 is swingably supported by the shaft member 77. The movable blade holder 30 includes a basal end portion 37, a distal end portion 38, an attachment portion 34, a movable blade 3, and a protrusive portion 31. The basal end portion 37 forms a lower end portion of the movable blade holder 30. The basal end portion 37 is swingably coupled with the shaft member 77 at a frontward position with respect to the first end 73A of the placement base 73. In other words, the basal end portion 37 is swingably supported by the first end 73A of the placement base 73. The distal end portion 38 forms an upper end portion of the movable blade holder 30 and faces the first-link second end portion 17 from a frontward position. The attachment portion 34 extends between the basal end portion 37 and the distal end portion 38 to face the motor 5 (see FIG. 2) from a rearward position. The movable blade 3 is a flat piece of blade, of which thickness aligns in the front-rear direction. In other words, the movable blade 3 spreads in directions orthogonal to the front-rear direction. The movable blade 3 is fixedly attached to a rearward surface of the attachment portion 34. A leftward end of the movable blade 3 is sharpened to form an edge 3A. The edge 3A protrudes slightly leftward from the attachment portion 34 along a swingable direction of the movable blade holder 30. The edge 3A may face the placement board 73D in the placement base 73 along the swingable direction of the movable blade holder 30. The protrusive portion 31 protrudes leftward from the distal end portion 38 along the swingable direction of the movable blade holder 30 and may face the placement board 73D along the swingable direction of the movable blade holder 30. A leftward end of the protrusive portion 31 is located slightly leftward with respect to the edge 3A.

As shown in FIG. 5, in the distal end portion 38, formed is a third groove cam 33, which engages with the third pin 13 in the second link member 20. The third groove cam 33 includes a first groove section 33A and a second groove section 33B. The first groove section 33A and the second groove section 33B are grooves integrated to extend continuously with each other. The first groove section 33A extends in a direction to be away from the shaft member 77 (see FIG. 4), and the second groove section 33B extends from the first groove section 33A in a direction to be further away from the shaft member 77. The first groove section 33A and the second groove section 33B extend in different directions.

As the second link member 20 swings, the third pin 13 may slide with respect to the third groove cam 33, and the movable blade holder 30 may swing about the shaft member 77 between a half-cutting position (see FIG. 7) and the retracted position (see FIG. 3). The half-cutting position is one of swingable positions for the movable blade holder 30, in which the leftward end of the protrusive portion 31 contacts the placement board 73D. The retracted position is another one of the swingable positions for the movable blade holder 30, in which the movable blade holder 30 is retracted rightward with respect to the half-cutting position. When the movable blade holder 30 is at the half-cutting position, the protrusive portion 31 contacts the placement board 73D. Meanwhile, when the movable blade holder 30 is at the half-cutting position, clearance is reserved between the edge 3A and the placement board 73D. An amount of the clearance in the crosswise direction is substantially equal to a thickness of the release paper in the printing medium 7. When the movable blade holder 30 is at the retracted position, the edge 3A is separated rightward from the printing medium 7 placed on the placement board 73D.

Figure 6:
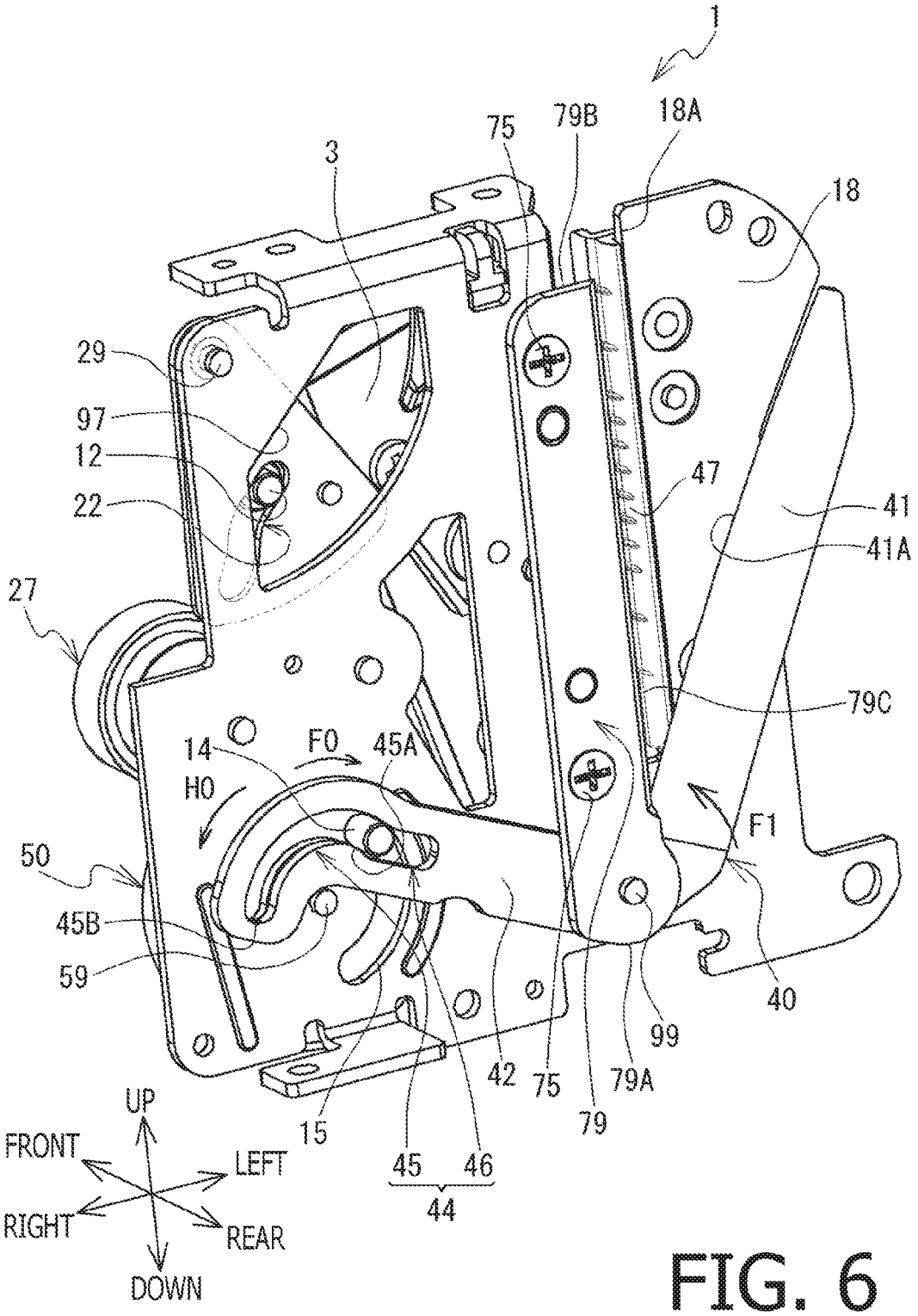
FIG. 6 is a perspective view of the cutting device 100 with a full-cutting blade 40 being at a separated position according to the embodiment of the present disclosure.

As shown in FIG. 6, on the rear side of the flat plate 18, attached are a stationary blade 79 and the full-cutting blade 40. The stationary blade 79 is fixed to the flat plate 18 by two (2) screws 75 at a rightward position with respect to the passage opening 18A spaced apart from the flat plate 18 in the front-rear direction. The stationary blade 79 has an approximate shape of a rectangular plate elongated in the vertical direction, in a rear view. The stationary blade 79 includes a first end 79A, a second end 79B, and an edge 79C. The first end 79A forms a lower end of the stationary blade 79, and a stationary shaft 99 axially extending in the front-rear direction is fixed thereto. The stationary shaft 99, although detailed illustration of which is omitted, protrudes frontward. The second end 79B forms an upper end of the stationary blade 79. The edge 79C forms a leftward end of the stationary blade 79 and is sharpened along the vertical direction. The printing medium 7 may be placed on the edge 79C between the first end 79A and the second end 79B. In this regard, the stationary blade 79 and the placement base 73 are the parts, on which the printing medium 7 to be cut may be placed thereon.

The full-cutting blade 40 has an approximate shape of an L in a front view and is swingably supported by the stationary shaft 99. The full-cutting blade 40 includes a first arm 41, which extends upward from the stationary shaft 99, and a second arm 42, which extends rightward from the stationary shaft 99. The first arm 41 has an edge 41A, which is sharpened along the extending direction of the first arm 41. The edge 41A may face the edge 79C of the stationary blade 79 along a swingable direction of the full-cutting blade 40. When the full-cutting blade 40 is at a full-cutting position (see FIG. 10), which will be described further below, a rearward surface of the edge 41A in the first arm 41 may contact a frontward surface of the edge 79C in the stationary blade 79.

In a rightward portion in the second arm 42, formed through the second arm 42 in the front-rear direction is a fourth groove cam 44. The fourth groove cam 44 engages with a fourth pin 14, which protrudes rearward from the rotating body 50 and is inserted through an arc hole 15 formed in the flat plate 18. The arc hole 15 is formed through the flat plate 18 in the front-rear direction and extends in an arc, which is centered at the shaft 59. A dimension of a breadth between inner edges of the arc hole 15 in a radial direction is larger than a diameter of the fourth pin 14. In this regard, when the fourth pin 14 moves along with the rotating body 50, the fourth pin 14 may not contact the inner edges of the arc hole 15.

The fourth groove cam 44 includes an arc cam 45 and a linear cam 46. The arc cam 45 and the linear cam 46 are integrated to extend continuously with each other. The arc cam 45 has a starting edge 45A on one end and a terminal edge 45B on other end. The arc cam 45 extends in an arc from the starting edge 45A to the terminal edge 45B centered about the shaft 59 in a counterclockwise direction in a rear view. The linear cam 46 extends linearly from the starting edge 45A of the arc cam 45 toward the stationary shaft 99. A distance between the center of the arc cam 45 and a breadthwise center of the arc cam 45 in the radial direction is equal to a distance between an axial center of the fourth pin 14 and an axial center of the shaft 59.

As the rotating body 50 rotates, the fourth pin 14 may slidably move with respect to the linear cam 46, and the full-cutting blade 40 may swing about the stationary shaft 99 between the full-cutting position (see FIG. 10) and a separated position (see FIG. 6). The full-cutting position is one of swingable positions for the full-cutting blade 40, in which the edge 41A is located rightward with respect to the edge 79C of the stationary blade 79. The separated position is another one of the swingable positions for the full-cutting blade 40, in which the edge 41A of the full-cutting blade 40 is separated leftward from the printing medium 7 placed on the edge 79C. The swingable direction of the full-cutting blade 40 is parallel with the swingable direction of the movable blade holder 30.

In the present embodiment, an action to slit the printing medium 7 to cut halfway may be called as a half-cutting action. With reference to FIGS. 4 and 7-9, described in the following paragraphs will be the half-cutting action by the cutting device 1. Before starting the half-cutting action, the printing medium 7 may be conveyed by the rollers in the printing apparatus 100 to a position beyond the passage opening 18A and placed on the placement board 73D. In this condition, the release paper in the printing medium 7 faces the placement board 73D. Meanwhile, before starting the half-cutting action, the cutting unit 100 is in a ready condition (see FIGS. 4 and 6). When the cutting device 1 is in the ready condition, the first pin 11 contacts the starting edge 51A; the second pin 12 contacts an upper end of the first cam section 22A; the third pin 13 contacts a lower edge of the first groove section 33A; the movable blade holder 30 is located at the retracted position; the fourth pin 14 contacts the starting edge 45A; and the full-cutting blade 40 is located at the separated position.

As the motor 5 (see FIG. 2) starts driving, the motor gear 5B rotates in a predetermined rotating direction, which will be called as a normal direction merely for the sake of convenience. The driving force from the motor 5 rotating in the normal direction is transmitted through the gear train 24 to the rotating body 50, and the rotating body 50 rotates in a clockwise direction in a front view, as indicated by an arrow H0. As the rotating body 50 rotates, the first groove cam 51 in the rotating body 50 rotates, pressing the first pin 11 rightward (see FIGS. 4 and 8). Thereby, the first link member 10 may swing in a counterclockwise direction in the front view, as indicated by an arrow H1. As the first link member 10 swings, the second pin 12 presses the first cam section 22A in the second groove cam 22 leftward and swing. Thereby, the second link member 20 slidably moves with respect to the flat plate 18 and swings in the clockwise direction in the front view, as indicated by an arrow H2. Along with the swing movement of the second link member 20, the third pin 13 presses the first groove section 33A in the third groove cam 33 leftward. Thereby, the movable blade holder 30 swings from the retracted position toward the half-cutting position, as indicated by an arrow H3. Meanwhile, the third pin 13 slidably moves from a first side, which is an end in a direction indicated by an arrow V1 shown in FIGS. 5 and 9, toward a second side, which is another end in a direction indicated by an arrow V2 shown in FIGS. 7 and 11, in the extending direction of the third groove cam 33.

As the movable blade holder 30 swings toward the half-cutting position, the fourth pin 14 slidably moves from the starting edge 45A toward the terminal edge 45B of the arc cam 45. Meanwhile, the distance between the center of the arc cam 45 and the breadthwise center of the arc cam 45 in the radial direction is equal to the distance between the axial center of the fourth pin 14 and the axial center of the shaft 59. Therefore, while the fourth pin 14 slidably moves in the arc cam 45, the second arm 42 may stay stationary without swinging, and the full-cutting blade 40 may stay at the separated position without moving.

Figure 7:
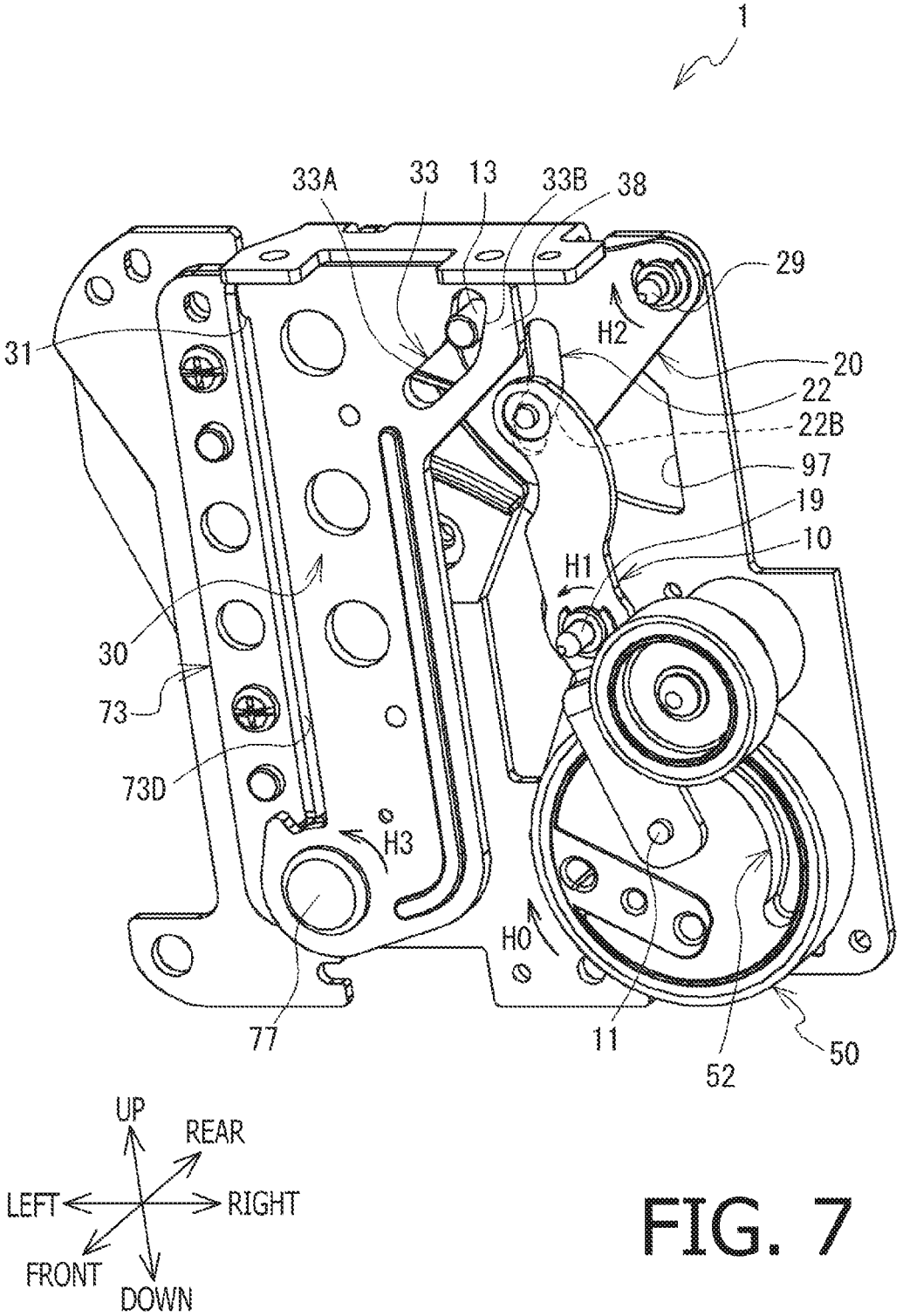
FIG. 7 is a perspective view of the cutting device 1 during a half-cutting action in the printing apparatus 100 according to the embodiment of the present disclosure.
Figure 8:
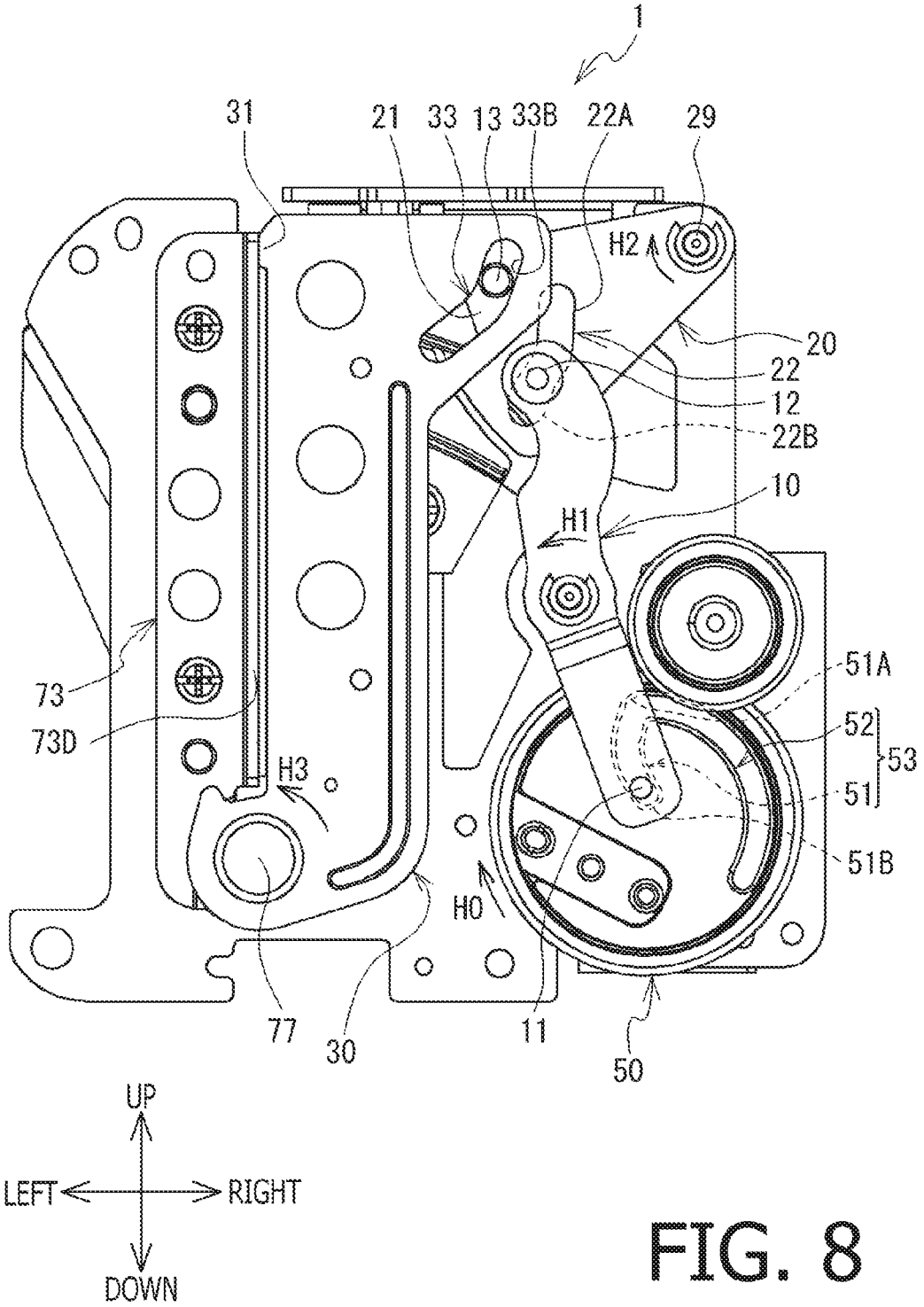
FIG. 8 is a front view of the cutting device 1 during the half-cutting action according to the embodiment of the present disclosure.
Figure 9:
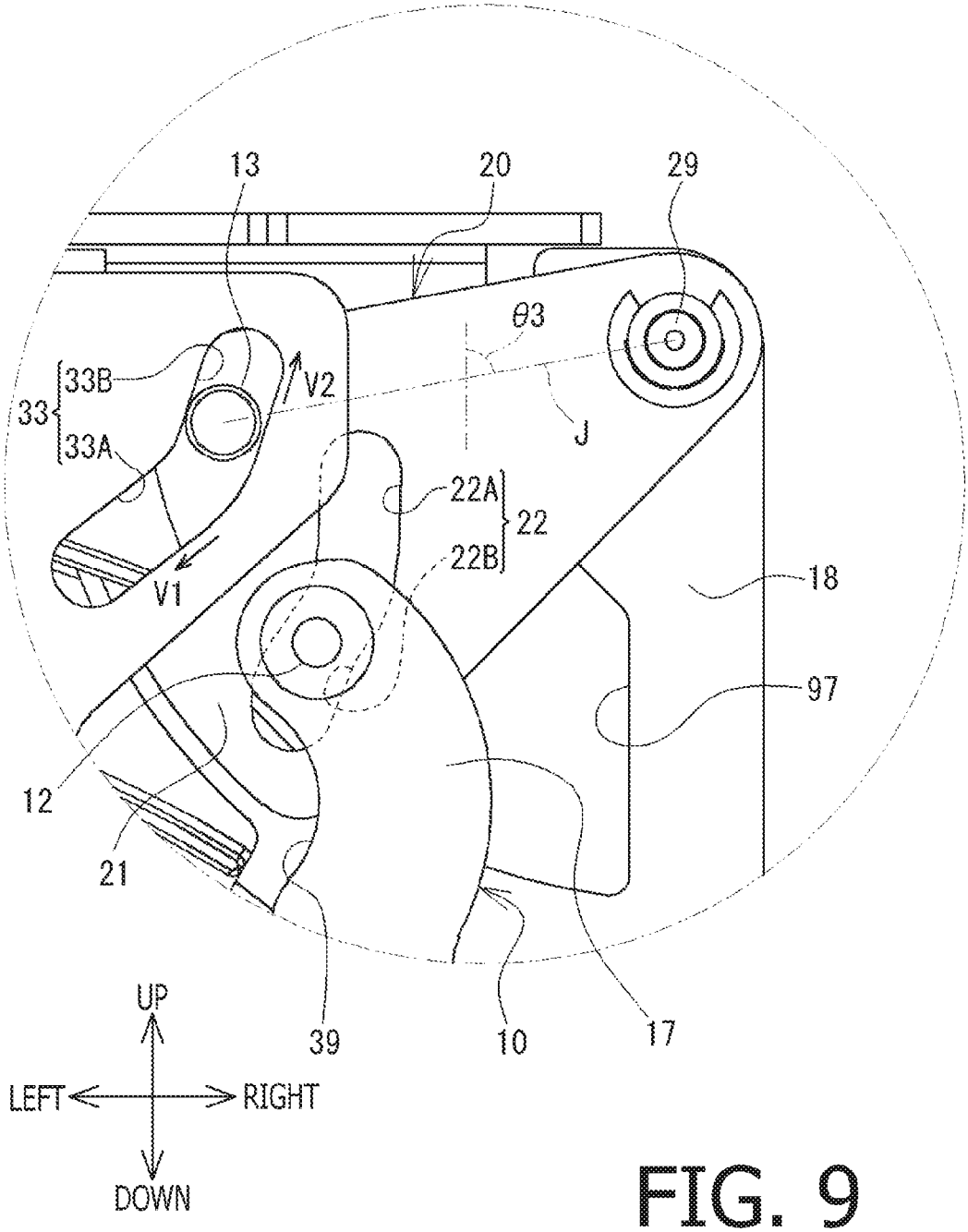
FIG. 9 is an enlarged front view of the second link member 20 in the cutting device 1 during the half-cutting action according to the embodiment of the present disclosure.

As shown in FIGS. 7-9, as the rotating body 50 rotates, the first pin 11 slidably moves toward the terminal edge 51B. The second pin 12 slidably moves with respect to the second groove cam 22 to exit the first cam section 22A and enter the second cam section 22B. Meanwhile, the third pin 13 slidably moves with respect to the third groove cam 33 to exit the first groove section 33A and enter the second groove section 33B. As the movable blade holder 30 continues swinging, the edge 3A of the movable blade 3 starts gradually slitting the printing medium 7 from the lower side to the upper side.

As the edge 3A starts slitting the printing medium 7, the second pin 12 swings with respect to the second cam section 22B and moves in a direction to be away from the second supporting shaft 29. Thereby, a load of an action to be caused by the first link member 10 to swing the second link member 20 through the second pin 12 may be restrained from increasing. Meanwhile, the extending direction of the second groove section 33B in the third groove cam 33 is more to upright, or more approximately parallel to the vertical direction, than the extending direction of the first groove section 33A. Therefore, the third pin 13 may push the second groove section 33B leftward more easily. Moreover, the third groove cam 33, which may receive the load by the third pin 13, is located in the distal end portion 38 in the movable blade holder 30. Therefore, the distal end portion 38 may be more difficult to be deformed by the load, and the cutting device 1 may apply cutting load to the printing medium 7 more effectively.

After the printing medium 7 is slit to the upper end thereof, the protrusive portion 31 contacts the placement board 73D, and the movable blade holder 30 reaches the half-cutting position. The movable blade 3 may slit the printing medium 7 to cut partially throughout the width of the printing medium 7 by the edge 3A while the release paper is left uncut. The motor 5 stops driving. In this condition when the movable blade holder 30 is at the half-cutting position, a predetermined acute angle θ3 (see FIG. 9) between the virtual line J and the vertical direction may be, for example, 80 degrees.

After cutting the printing medium 7 halfway, the motor 5 drives in a direction opposite to the normal direction. The direction opposite to the normal direction will be called as a reverse direction, merely for the sake of convenience. The rotating body 50, the first link member 10, the second link member 20, and the movable blade holder 30 move in respective directions opposite to the directions moved in the earlier stage of the half-cutting action. The third pin 13 returns to the inner side of the recessed portion 39, and the cutting device 1 returns to the ready condition. The motor 5 stops driving, and the half-cutting action is completed.

Figure 10:
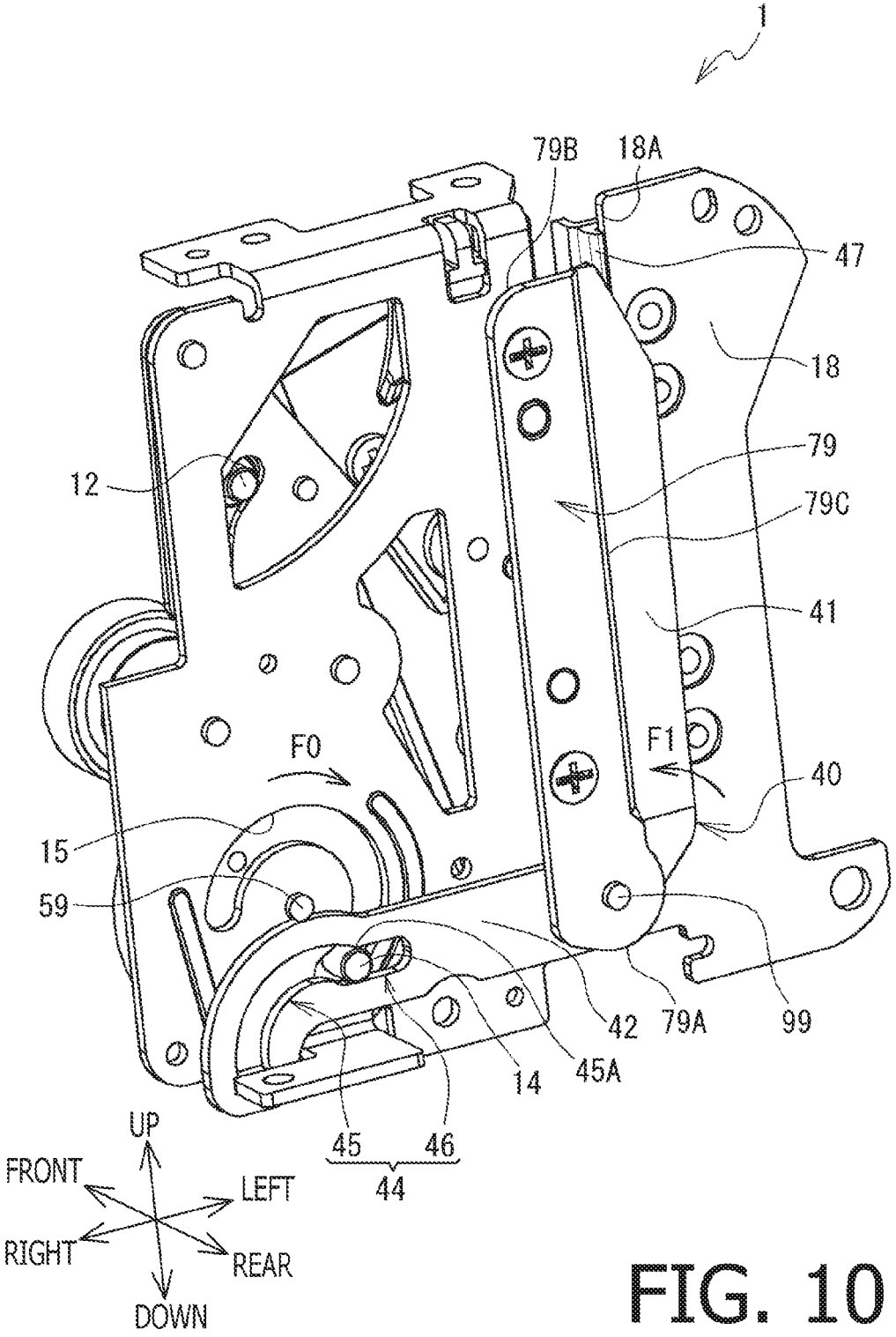
FIG. 10 is a perspective view of the full-cutting blade 40 at a full-cutting position in the cutting device 1 according to the embodiment of the present disclosure.

On the other hand, in the present embodiment, an action to cut the printing medium 7 fully may be called as a full-cutting action. With reference to FIGS. 4, 6, and 10, described in the following paragraphs will be the full-cutting action by the cutting device 1. Before starting the full-cutting action, the cutting device 1 is in the ready condition.

The motor 5 drives to rotate in the reverse direction, and the rotating body 50 rotates in a counterclockwise direction, as indicated by an arrow F0, in a front view. Meanwhile, the specific groove cam 52 (see FIG. 4) in the rotating-body groove cam 53 may slidably move with respect to the first pin 11. However, the specific groove cam 52 is in the arc shape centered about the shaft 59. Therefore, the rotating-body groove cam 53 may not press the first pin 11. Accordingly, neither the first link member 10 nor the second link member 20 may swing so that the movable blade holder 30 may be maintained stopped at the retracted position.

As the rotating body 50 rotates, the fourth pin 14 slidably moves with respect to the linear cam 46, pressing the linear cam 46 downward, or counterclockwise. Thereby, the full-cutting blade 40 starts swinging toward the full-cutting position in a direction indicated by an arrow F1. As the fourth pin 14 slidably moves with respect to the linear cam 46, the full-cutting blade 40 nips the printing medium 7 at a position between the edge 41A thereof and the edge 79C of the stationary blade 79 gradually from the lower side to the upper side so that the printing medium 7 may be cut into separate pieces. After the edge 79C cuts through the printing medium 7 vertically, the full-cutting blade 40 reaches the full-cutting position. Thus, the full-cutting blade 40 may fully cut the printing medium 7 through the width and the thickness with the edges 41A, 79C. The motor 5 stops driving. After fully cutting the printing medium 7, the motor 5 drives to rotate the motor gear 5B in the normal direction. The rotating body 50 and the full-cutting blade 40 move in respective directions opposite to the directions moved in the earlier stage of the full-cutting action. The cutting device 1 returns to the ready condition. The motor 5 stops driving, and the full-cutting action is completed.

As described above, the movable blade holder 30 is connected with the second link member 20 at the upper position with respect to the shaft member 77, which is the swing axis of the movable blade holder 30, while the movable blade 3 is fixed to the movable blade holder 30 at the attachment portion 34. In this regard, in the conventional half-cutting device, the position to connect the movable blade holder 30 with the second link member 20 and the position of the attachment portion 34 in the movable blade holder 30 would align vertically across the connecting position between the movable blade holder 30 and the second link member 20, and a larger room to accommodate the cutting device may be needed. In contrast, according to the embodiment of the present disclosure, a volume of the movable blade holder 30 may be reduced, and the cutting device 1 may be downsized.

The rotating body 50 is located rightward from the basal end portion 37 of the movable blade holder 30. The motor 5 is located rightward from the placement board 73D of the placement base 73. In other words, while the placement board 73D is located at a position between the first end 73A and the second end 73B of the placement base 73, the motor 5 is located rightward from the position between the first end 73A and the second end 73B of the placement base 73. Meanwhile, the second shaft 29 is located rightward from the second end 73B of the placement base 73. Moreover, the first supporting shaft 19 is located at a position between the second link member 20 and the rotating body 50 in the vertical direction and rightward from the placement board 73D of the placement base 73 in the crosswise direction. Therefore, the motor 5, the rotating body 50, the first link member 10 and the second link member 20 are efficiently collected in the rightward area with respect to the movable blade holder 30. Moreover, the motor 5, the rotating body 50, the first link member 10 and the second link member 20 stay off from the lower area with respect to the shaft member 77, which is the swing axis of the movable blade holder 30. Therefore, the cutting device 1 may be downsized even more efficiently.

The attachment portion 34 in the movable blade holder 30 is arranged to face the motor 5 from the rearward position. In other words, the motor 5 faces the movable blade holder 30 from the downstream side in the conveying direction. In this arrangement where the motor 5 and the movable blade holder 30 face each other along the conveying direction, the movable blade holder 30 and the motor 5 may be relatively movable to move closer to each other along the conveying direction, i.e., the front-rear direction. Therefore, dimensions of the area to arrange the movable blade holder 30 and the motor 5 are reducible in the crosswise direction, and the cutting device 1 may further be downsized.

When the motor 5 is activated, and the rotating body 50 rotates clockwise in the front view as indicated by the arrow H0, the movable blade holder 30, selectively between the movable blade holder 30 and the full-cutting blade 40, swings to the half-cutting position. On the other hand, when the rotating body 50 rotates counterclockwise in the front view as indicated by the arrow F0, the full-cutting blade 40, selectively between the movable blade holder 30 and the full-cutting blade 40, swings to the full-cutting position. In other words, the cutting device 1 may move either the movable blade holder 30 or the full-cutting blade 40 by switching the rotating directions of the rotating body 50. Thus, the half-cutting action and the full-cutting action may be switched easily in the cutting device 1.

The gear train 24 is located rightward from the motor 5. The gears in the gear train 24 are collectively arranged at the rightward positions with respect to the motor 5 along the vertical direction. Therefore, a dimension of the area to arrange the gear train 24 may be reduced in the crosswise direction. Moreover, the fourth gear 28 is formed integrally with the rotating body 50. Therefore, the dimension of the area to arrange the gear train 24 may be even more effectively reduced, and the cutting device 1 may be downsized even more effectively.

The distance of separation between the third pin 13 and the second supporting shaft 29, i.e., the dimension P shown in FIG. 5, is longer than the distance of separation between the first groove cam 51 and the shaft 59, i.e., the dimension L shown in FIG. 4. Accordingly, the swinging amount for the movable blade holder 30 that is moved by the second link member 20 through the third pin 13 as the rotating body 50 rotates may increase compared to the rotation amount of the rotating body 50. Thus, the movable blade holder 30 may be moved for the larger swinging amount. Therefore, the cutting device 1 may provide the larger swinging movement of the movable blade holder 30 while the volume of the cutting device 1 may be reduced.

The distance of separation between the second pin 12 and the first supporting shaft 19, i.e., the dimension S shown in FIG. 4, is longer than the distance of separation between the first pin 11 and the first supporting shaft 19, i.e., the dimension M shown in FIG. 4. The swinging amount of the second pin 12 is larger than the swinging amount of the first pin 11. Accordingly, the swinging amount for the second link member 20 that is moved by the first link member 10 through the second pin 12 as the rotating body 50 rotates may increase compared to the swinging amount for the first link member 10. Therefore, the cutting device 1 may provide the larger swinging movement of the movable blade holder 30 while the volume of the cutting device 1 may be reduced.

The distance of separation between the third pin 13 and the second supporting shaft 29, i.e., the dimension P shown in FIG. 5, is longer than the distance of separation between the second groove cam 22 and the second supporting shaft 29, i.e., the dimension T shown in FIG. 5. Accordingly, the swinging amount for the third pin 13 may increase compared to the swinging amount of the second groove cam 22. In other words, the swinging amount for the movable blade holder 30 that is moved by the second link member 20 through the third pin 13 may increase compared to the swinging amount for the second link member 20. Therefore, the cutting device 1 may provide the larger swinging movement of the movable blade holder 30 while the volume of the cutting device 1 may be reduced.

The second-link end portion 21, the first-link second end portion 17, and the distal end portion 38 align from the rear to the front in this given order along the front-rear direction. The axes of the second pin 12, the third pin 13, and the second supporting shaft 29 extend in the front-rear direction in parallel with one another. The second pin 12 protrudes from the first-link second end portion 17 rearward, toward the second link member 20. The third pin 13 protrudes from the second-link first end portion 21 frontward, toward the movable blade holder 30. While the second pin 12 is located rearward with respect to the movable blade holder 30, clearance to avoid collision between the second pin 12 and the movable blade holder 30 in the front-rear direction may not necessarily be reserved. In this regard, the distal end portion 38 in the movable blade holder 30 may be located to be closer to the first-link second end portion 17, and the volume of the cutting device 1 may be reduced even more efficiently.

The flat plate 18 is arranged to face and contact the second link member 20 from the rearward position; therefore, a volume of the area to arrange the flat plate 18 and the second link member 20 may be reduced in the front-rear direction. Moreover, the second pin 12, which protrudes rearward from the first-link second end portion 17, is inserted in the through-hole 97 in the flat plate 18. Therefore, a volume of the area to arrange the second pin 12 and the flat plate 18 may be reduced in the front-rear direction. Thus, the cutting device 1 may be downsized even more efficiently.

The first-link second end portion 17 is, even when the first-link second end portion 17 is at the swingable position closest to the third pin 13, separated from the third pin 13 due to the form of the first-link second end portion 17 with the recessed portion 39, which provides clearance between the first-link second end portion 17 and the third pin 13. In other words, the first-link second portion 17 is separated from the third pin 13 at all times regardless of the swingable positions of the first member 10 including the swingable position closest to the third pin 13. Therefore, collision between the first-link second end portion 17 and the third pin 13 may be prevented, and the larger swinging amount for the movable blade holder 30 may be reserved. Accordingly, the cutting device 1 may provide the larger swinging movement of the movable blade holder 30 while the volume of the cutting device 1 may be reduced.

Although an example of carrying out the invention have been described, those skilled in the art will appreciate that there are numerous variations and permutations of the cutting device that fall within the spirit and scope of the disclosure as set forth in the appended claims. It is to be understood that the subject matter defined in the appended claims is not necessarily limited to the specific features or act described above. Rather, the specific features and acts described above are disclosed as example forms of implementing the claims.

For example, the movable blade 3 attached to the movable blade holder 30 may not necessarily cut the printing medium 7 halfway but may cut the printing medium 7 fully. In order to cut the printing medium 7 fully by the movable blade 3, the edge 3A of the movable blade 3 may be arranged to contact the placement base 73 when the movable blade holder 30 is at the half-cutting position. For another example, the placement base 73 may be replaced with the stationary blade 79. For another example, the second-link end portion 21, the first-link second end portion 17, and the distal end portion 38 may not necessarily be arranged to align from the rear to the front along the front-rear direction but may be arranged to align form the front to the rear along the front-rear direction.

What is claimed is:

1. A cutting device configured to cut a printing medium, comprising:

a rotating body configured to be driven to rotate by a driving force from a driving source;

a first link member swingably supported by a frame, the first link member being configured to swing according to rotation of the rotating body;

a second link member swingably supported by the frame, the second link member being configured to swing according to swing movement of the first link member;

a placement part fixed to the frame, the placement part comprising a first end on one side of the cutting device in a predetermined direction and a second end on the other side of the cutting device opposite to the first end in the predetermined direction, the placement part being configured to place the printing medium thereon at a position between the first end and the second end; and a movable blade holder configured to swing according to swing movement of the second link member, the movable blade holder comprising:

a basal end portion located on one end on the one side of the cutting device in the predetermined direction, the basal end portion being swingably supported by the placement part at the first end;

a distal end portion located on the other end opposite to the basal end portion on the other side of the cutting device in the predetermined direction, the distal end portion being connected with the second link member; and an attachment portion located between the basal end portion and the distal end portion, the attachment portion being configured to attach a movable blade thereon, the movable blade being configured to cut the printing medium, wherein the movable blade holder is configured to swing between a cutting position, at which the printing medium is nipped between the movable blade and the placement part to be cut by the movable blade, and a retracted position retracted from the cutting position.

2. The cutting device according to claim 1, wherein the rotating body is located at a position sideward from the basal end portion of the movable blade holder in a predetermined orientation orienting from the second end of the placement part toward the distal end portion of the movable blade holder, wherein the driving source is located at a position sideward in the predetermined orientation from a predetermined position of the placement part between the first end and the second end in the predetermined direction, wherein a swing axis of the second link member is located at a position sideward from the second end of the placement part in the predetermined orientation, and wherein the first link member is located at a position between the second link member and the rotating body, sideward in the predetermined orientation from a center of the placement part in the predetermined direction.

3. The cutting device according to claim 1, wherein the driving source is arranged to face the movable blade holder from a position downstream with respect to the movable blade holder in a conveying direction to convey the printing medium in the cutting device.

4. The cutting device according to claim 3, further comprising:

a full-cutting blade located upstream with respect to the movable blade holder in the conveying direction, the full-cutting blade being swingable according to rotation of the rotating body in a direction parallel with a swingable direction of the movable blade holder, wherein the placement part comprises:

a placement base arranged to face the movable blade along the swingable direction of the movable blade holder; and a stationary blade arranged to face the full-cutting blade along a swingable direction of the full-cutting blade, wherein the cutting position is a half-cutting position, at which the movable blade cuts the printing medium between the movable blade and the placement base, wherein the full-cutting blade is configured to swing between a full-cutting position, at which the full-cutting blade cuts the printing medium between the full-cutting blade and the stationary blade fully, and a separated position separated from the full-cutting position, and wherein the rotating body is configured to:

by rotating in a first rotating direction, cause the movable blade holder to swing to the half-cutting position selectively between the movable blade holder and the full-cutting blade; and by rotating in a second rotating direction opposite to the first rotating direction, cause the full-cutting blade to swing to the full-cutting position selectively between the movable blade holder and the full-cutting blade.

5. The cutting device according to claim 3, wherein the driving source comprises a motor including an output shaft, wherein the cutting device further comprises:

a motor gear fixed to the output shaft; and a gear train comprising a plurality of gears configured to transmit the driving force transmitted through the motor gear to the rotating body, the gear train being arranged along the predetermined direction at a position sideward from the motor in a predetermined orientation orienting from the second end of the placement part toward the distal end portion of the movable blade holder, and wherein a specific gear at a downstream end of a driving-force transmitting flow within the plurality of gears in the gear train is formed integrally with the rotating body.

6. The cutting device according to claim 1, wherein the rotating body comprises a first groove cam, wherein the first link member comprises:

a first-link first end portion located on one end of the first link member on the one side of the cutting device in the predetermined direction, the first-link first end portion comprising a first pin, the first pin engaging with the first groove cam; and a first-link second end portion located on the other end opposite to the first-link first end portion on the other side of the cutting device in the predetermined direction, the first-link second end portion comprising a second pin, wherein the second link member comprises a second-link end portion, the second-link end portion comprising a third pin and a second groove cam, the second groove cam engaging with the second pin, wherein the distal end portion in the movable blade holder comprises a third groove cam, the third groove cam engaging with the third pin, wherein the first link member is configured to swing according to sliding movement of the first groove cam with respect to the first pin caused by rotation of the rotating body, wherein the second link member is configured to swing according to sliding movement of the second pin with respect to the second groove cam caused by swinging movement of the first link member, wherein the movable blade holder is configured to swing, according to sliding movement of the third pin with respect to the third groove cam caused by swinging movement of the second link member, and wherein a distance of separation between the third pin and a swing axis of the second link member is longer than a distance of separation between the first groove cam and a rotation axis of the rotating body.

7. The cutting device according to claim 6, wherein a distance of separation between the second pin and a swing axis of the first link member is longer than a distance of separation between the first pin and the swing axis of the first link member.

8. The cutting device according to claim 6, wherein the distance of separation between the third pin and the swing axis of the second link member is longer than a distance of separation between the second groove cam and the swing axis of the second link member.

9. The cutting device according to claim 6, wherein an axis of the second pin, an axis of the third pin, and the swing axis of the second link member extend in parallel with one another in an axial direction, wherein the second-link end portion, the first-link second end portion, and the distal end portion of the movable blade holder align in this given order along the axial direction, and wherein the second pin protrudes from the first-link second end portion toward the second link member, and wherein the third pin protrudes from the second-link end portion toward the movable blade holder.

10. The cutting device according to claim 9, wherein the frame comprises:

a flat plate configured to face and contact the second link member from a side opposite to the first-link second end portion along the axial direction; and a through-hole formed through the flat plate, the second pin in the first-link second end portion being configured to be inserted in the through-hole.

11. The cutting device according to claim 9, wherein the first-link second end portion comprises a recessed portion, which is separated from the third pin at all time regardless of swingable positions of the first link member including a swingable position closest to the third pin.

12. The cutting device according to claim 1, wherein the distal end portion includes a protrusive portion.

13. The cutting device according to claim 12, wherein the protrusive portion contacts the placement part when the movable blade holder is at the cutting position.

* * * * *